US005269520A

United States Patent [19]

Vellines

[11] Patent Number: 5,269,520

[45] Date of Patent: Dec. 14, 1993

[54] STREET HOCKEY PUCK

[76] Inventor: John W. Vellines, 1024 Jamestown Cres., Norfolk, Va. 23508

[21] Appl. No.: 19,762

[22] Filed: Feb. 19, 1993

[51] Int. Cl.[5] ..... A63B 71/00

[52] U.S. Cl. ..... 273/128 R

[58] Field of Search ..... 273/126 R, 126 A, 128 R, 273/128 CS, 128 A, 57.2

[56] References Cited

U.S. PATENT DOCUMENTS

| | | | |
|---|---|---|---|
| 591,146 | 10/1897 | Stannard | 273/155 |
| 2,226,516 | 12/1940 | Ross | 273/128 R |
| 3,117,788 | 1/1964 | Buonanno et al. | 273/128 R |
| 4,111,419 | 9/1978 | Pellegrino | 273/57.2 |
| 4,555,114 | 11/1985 | Dozier | 273/128 R |
| 4,793,769 | 12/1988 | Dolan . | |

*Primary Examiner*—Vincent Millin

*Assistant Examiner*—Raleigh W. Chiu

*Attorney, Agent, or Firm*—Stephen E. Clark

[57] ABSTRACT

A multi-layered street hockey puck adapted for use on paved playing surfaces has a plurality of like-sized discs axially aligned and fastened together at their centers. Each disc is secured against axial and radial movement relative to each other, but is advantageously constructed to independently resonate parallel to the axis of the puck so as to reduce the tendency of the puck to bounce or flip over during use. Plurality of openings extending longitudinally between opposite faces of the puck advantageously reduce the gross weight of the puck and reduces the net wind drag force against the puck when in an overturned orientation, while leaving the net density of the puck sufficiently high to maintain momentum and "feel" of the puck when in use.

17 Claims, 3 Drawing Sheets

STREET HOCKEY PUCK

FIELD OF INVENTION

The present invention relates to disc-shaped pucks used in the sport of street hockey. In particular, the present invention relates to street hockey pucks which are generally designed for use on smooth to semi-smooth, flat surfaces.

BACKGROUND OF THE INVENTION

Street hockey is commonly played with either a ball or with a plastic disc-shaped object ("puck") similar in appearance to an ice hockey puck. While the size of street hockey pucks is similar to the size of regulation ice hockey pucks (which are approximately 3 inch (7.62 cm) diameter and 1 inch (2.54 cm) thick), other characteristics are necessarily different due to the varying characteristics of the playing surface upon which the two sports are played.

Whereas common ice hockey pucks are typically constructed of rubber and, when struck, may slide nicely on either of their two flat sides over ice, when such pucks are used on relatively more rough playing surfaces (such as floors, paved streets, parking lots, or other surfaces) they do not glide smoothly across such surfaces, but rather tend to stick or sporadically bounce and roll across such non-slick surfaces.

To overcome some of the problems relating to prior disc-shaped pucks travelling over non-slick surfaces, balls have been employed on occasion in street hockey games in place of disc-shaped pucks due to the ability of the balls to roll smoothly over most flat surfaces. Although balls generally travel more evenly, smoothly and controllably over relatively rough playing surfaces than do ice hockey pucks and prior street hockey pucks, the fact that the balls are spherically shaped (rather than disc-shaped) inherently changes the nature of the game when balls are used. Other problems associated with the use of balls are that they interact poorly with hockey sticks and they tend to travel at high speeds.

Plastic street hockey pucks of various designs are known. Some prior street hockey puck designs incorporate the use of ball bearings, (for example as disclosed in U.S. Pat. No. 4,793,769). Although the use of ball bearings in street hockey puck design does allow a rolling effect on the playing surface, many surfaces are not quite smooth enough to effect a desirable consistency of performance of the puck, as such prior puck designs do not provide for the dissipation of the frictional effects of these surfaces; hence the puck tends to tumble and roll in an undesirable way. The ball bearings themselves of such prior pucks are also easily scarred and soiled as to prohibit their efficient rolling motion; and the cost to manufacture street hockey pucks comprising ball bearings is typically significantly higher than the cost of manufacturing pucks without ball bearings.

Other prior street hockey pucks are generally of single component construction, typically being molded into a homogenous plastic disc. This prior design typically varies from the construction of ice hockey pucks principally in that the street hockey pucks are typically made of plastic (having a density of 0.89 to 0.93 to grams per cubic centimeter), which is significantly less dense than regulation ice hockey pucks which are made of vulcanized rubber (having a density of 1.34 to 1.46 grams per cubic centimeter). Accordingly, prior plastic pucks typically are of relatively light-weight and tend to bounce and tumble easily after being struck with a hockey stick. This prior design of street hockey puck typically renders the puck very hard for the player to "feel" while dribbling the puck (due to its very light weight, and due to its rapid loss of speed/momentum).

As a consequence of the relatively light weight of these prior street hockey pucks- (typically prior plastic street hockey pucks 3.75" (9.52 cm) diameter by 7/8" (2.22 cm) thick weigh in the range of 140 to 146 grams)- several unfavorable things occur. As will be appreciated by those skilled in the art, because the net frictional force between the puck and the playing surface and the momentum of the travelling puck are both directly proportional to the weight of the puck, the rate of deceleration resulting from friction between a puck and a playing surface is independent of the weight (or density) of the puck.

However, because the net friction force between the puck and the air (i.e. wind drag) depends only on the geometry of the puck and its speed through the air, and is therefore independent of the weight (or density) of the puck, a low weight (or low density) puck may be slowed down considerably more by air friction than would a similarly sized and similarly shaped heavier (or more dense) puck. Accordingly, due to the relatively low density of common prior plastic street hockey pucks (i.e. less than 0.94 grams per cubic centimeter), prior pucks disadvantageously lose speed more quickly as a consequence of wind drag, than do regulation ice hockey pucks (1.34 to 1.46 grams per cubic centimeter).

In addition, the combined effects of wind drag on the relatively light-weight prior plastic pucks, together with the relatively high coefficient of restitution associated with the homogeneous construction of prior molded pucks, tend to cause prior pucks to bounce and tumble across the playing surfaces in an undesirable manner, rather than slide on the flat plane of the playing surface.

All of these, above, factors associated with prior street hockey pucks tend to change the nature of the game from a fast-paced game of skill to one of luck and chance.

The most desirable performance characteristic for street hockey pucks is that they substantially simulate the performance of ice hockey pucks in ice hockey games. However, the similarity of performance between ice hockey pucks used in ice hockey games and street hockey pucks used in street hockey games is often compromised due to the relatively higher surface friction inherent in street hockey playing surfaces as compared with ice hockey playing surfaces (i.e. smooth ice). The typical range for coefficient of friction (sliding) between a regulation ice hockey puck (vulcanized rubber) and ice is 0.05 to 0.20. The typical range of coefficient of friction (sliding) between prior plastic disc-shaped street hockey pucks and cement or asphalt pavements is approximately 0.40 to 0.70 for molded plastic pucks, and 0.50 to 0.80 for molded synthetic rubber pucks.

Standard ice hockey pucks are of substantial mass (approximately 156–170 grams) and are heavy enough to be "felt" by the player while being handled with a hockey stick. A puck of reduced weight (i.e. below 150 grams) is hard to "feel" when stick handling (dribbling) the puck over the playing surface. Lightweight puck construction requires the player to watch the puck, as opposed to being able to "feel" it with the stick.

Street hockey balls are used to combat the effects of friction on semi-smooth surfaces. These hollow balls are effective in combatting frictional effects but, as discussed above, do not behave characteristically like an ice hockey puck. In many prior street hockey ball designs, the ball is constructed of a compressible synthetic rubber, or the like. The compressibility of such balls introduces undesirable performance of the balls, due to the energy loss when the stick strikes the ball.

SUMMARY OF THE INVENTION

The primary object of the present invention is to provide a street hockey puck which, when used on various non-slick playing surfaces (such as concrete and asphalt,) substantially simulates the performance characteristics of an ice hockey puck used on an ice playing surface, hence allowing the game of street hockey to be played on various surfaces without compromising the nature of the game.

Another object of the present invention is to provide a puck of the character described that is substantially disc-shaped and may readily slide on either of its two parallel faces over such non-slick playing surfaces.

It is another object of the present invention to provide a street hockey puck of the character described comprising a plurality of axially aligned, discrete disc layers which advantageously absorb shock directed parallel to the axis of said discs, so as to reduce the tendency of the puck to bounce over such non-slick playing surfaces.

It is another object of the present invention to provide a street hockey puck of the character described wherein said axially aligned, discrete disc layers are secured to one another by a centrally located fastening member.

It is another object of the present invention to provide a street hockey puck of the character described in which the central fastening member is of relatively higher density and of relatively higher abrasion resistance than either of the outside discrete disc layers, so as to increase the gross density of the puck.

It is a further object of the present invention to provide a street hockey puck of the character described in which the outside edges of the outside disc layers are beveled so as to reduce the tendency of a leading edge of the puck to dig into the playing surface.

Further objects and advantages of my invention will become apparent from a consideration of the drawings and ensuing description thereof.

DRAWINGS

DESCRIPTION

Figure 1:
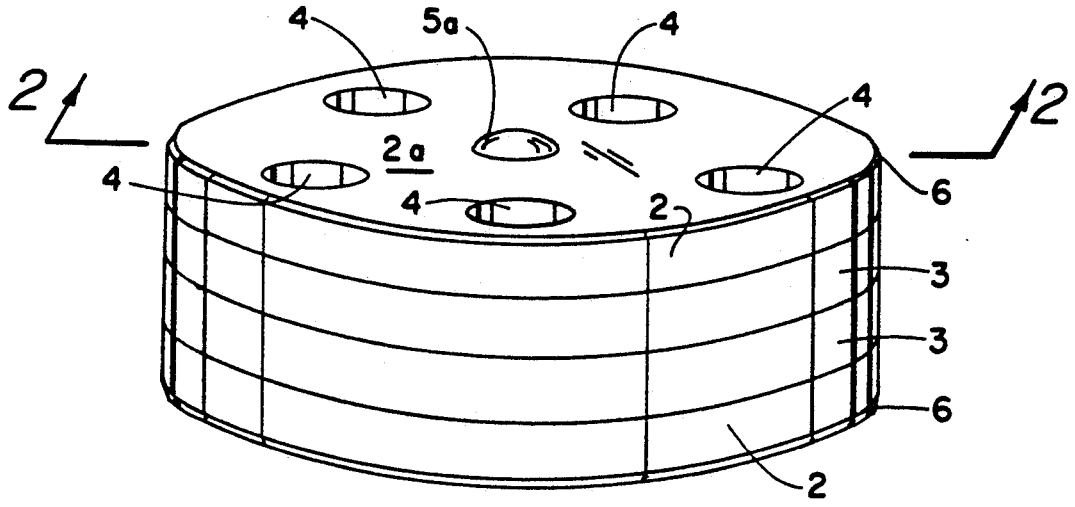
FIG. 1 is a perspective view of the present invention.

As will be described in further detail below, the present invention is a multi-layered, disc-shaped street hockey puck (generally designated in its entirety as 1 in the figures) which is designed to slide across a paved, substantially flat, horizontal playing surface (generally designated S in the figures).

In the preferred embodiment of the invention the hockey puck 1 comprises two interior discs 3 sandwiched between two outside discs 2 and secured together along their respective centers with fastener 5.

The interior discs 3 and the exterior discs 2 all have the same outside diameter and are axially aligned with one another so as to effect a substantially cylindrically shaped side wall 1*a* when the puck 1 is assembled as shown in the figures.

In the preferred embodiment of the invention the interior discs 3 and the outside discs 2 are each 7/32" (0.55 cm) thick and each has an outside diameter of 3¾" (9.52 cm). Thus, when the two interior discs 3 and the two outside discs 2 are assembled as shown in the figures, the assembled puck 1 is 3¾" (9.52 cm) in diameter and approximately ⅞" (2.22 cm) thick. Preferably, the interior discs 3 and the outside discs 2 are each constructed of high density polyethylene (having a density of approximately 0.94 to 0.96 grams per cubic centimeter).

A 1/32" beveled edge 6 is preferably provided at the exposed corner of the two outside discs 2. In operation, the beveled edges 6 facilitate the puck's lateral movement across a playing surface, and prevents undesirable "digging in" of the leading edge of the puck 1 into the playing surface (which could have the possible undesirable effect of upsetting or bouncing the puck 1).

In the preferred embodiment of the invention the fastener 5 is a rigid metallic pin, such as a rivet, which extends through each of the outside and interior discs 2 and 3, respectively, and which has a mass density of substantially greater than the density the discs 2 and 3. The fastener 5 is preferably approximately ¼" in diameter and secures the various disc members 2 and 3 from radial movement and axial rotation relative to each other. Additionally, the fastener 5 secures the various disc members 2 and 3 from axially moving at their centers relative to each other (i.e. perpendicular to the parallel faces of the disc members).

Figure 3:
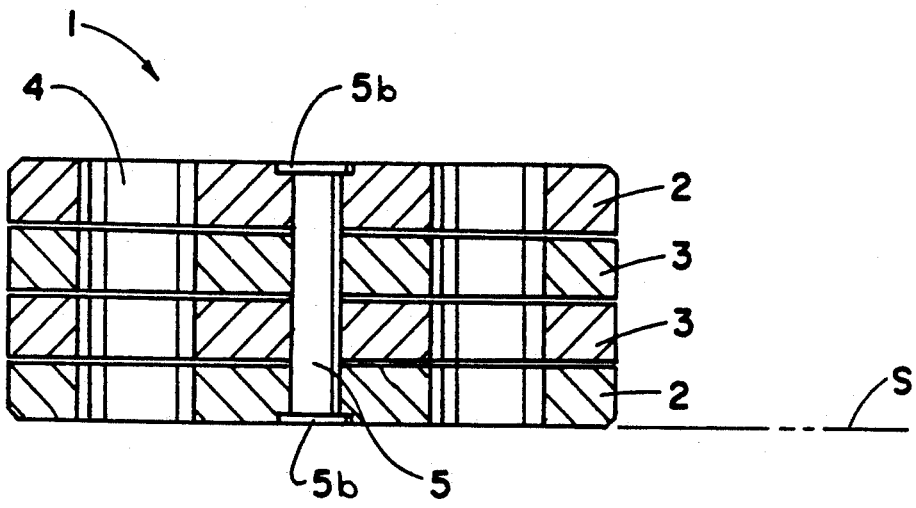
FIG. 3 is a medial cross-section view similar to FIG. 2, but showing a modified fastener.
Figure 4:
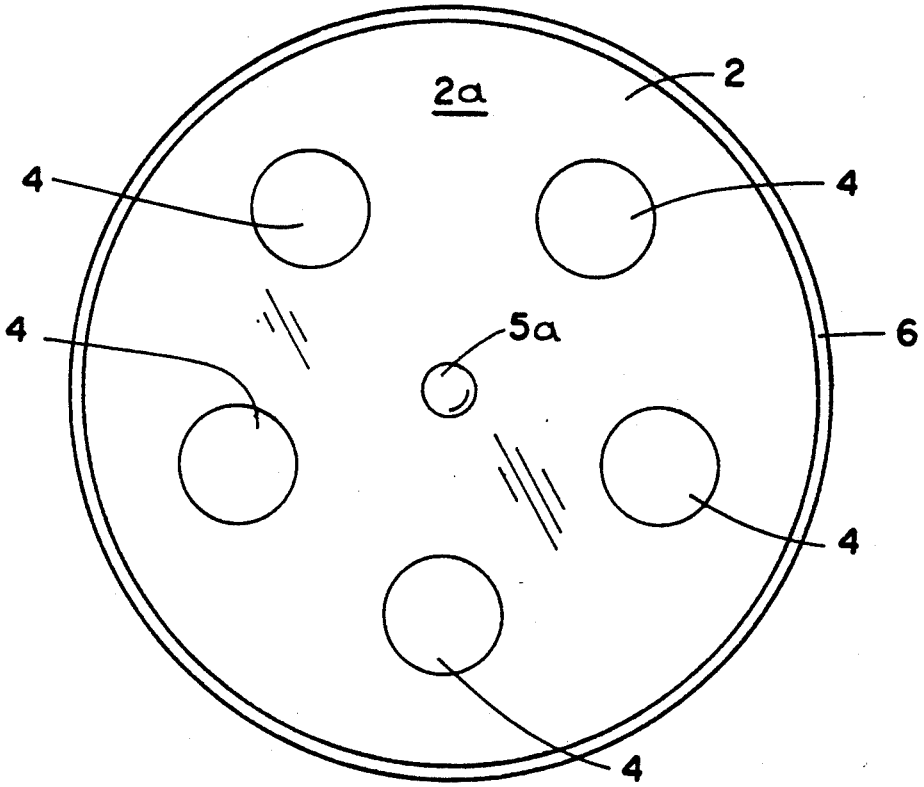
FIG. 4 is a plan view of the present invention.

In the preferred embodiment of the invention the fastener 5 comprises a pin made of steel (having a density of approximately 8 times that of the high density polyethylene), however it is within the scope of this invention to use fasteners of other materials. In the preferred embodiment of the invention rivet heads 5*a* protrude beyond the flat face 2*a* of the outside discs 2. This construction is considered preferable because the metallic rivet head 5*a*, being more durable and resistant to abrasion than the polyethylene outside discs 2, absorbs the majority of the impact and friction as the puck slides across the playing surface S. A modification of the present invention is shown in FIG. 3 in which the head 5*b* of the fastener 5 is recessed below the surface of the outside disc 2. An advantage of this construction of the puck 1 is that the puck 1 can slide horizontally across a flat (horizontal) playing surface, as the face 2*a* of the outside disc 2 may lie flat against the playing surface S.

Figure 2:
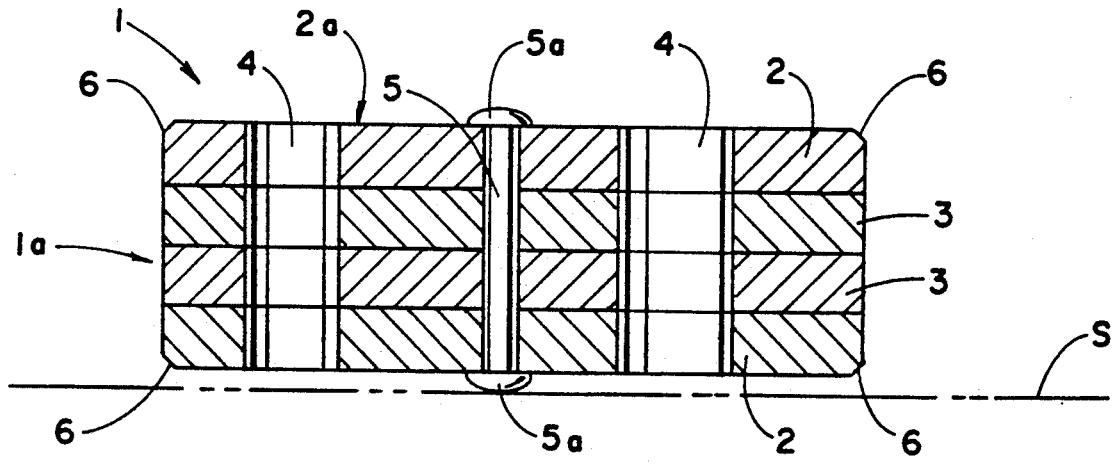
FIG. 2 is a cross-sectional view of the present invention taken along the line 2—2 of FIG. 1.

In the preferred embodiment of the invention, five 1-inch diameter holes 4 extend through each of the interior discs 3 and each of the outside discs 2, such that when the various discs 2 and 3 are assembled as described above, the holes 4 in each of the discs 2 and 3 are aligned so as to effect five continuous openings through the assembled puck 1 as shown in FIG. 2.

OPERATION

The disclosed puck 1 is designed to be used in a game of street hockey, or the like, wherein a stick, club, bat, or the like is used to strike the puck 1, causing it to traverse over a relatively flat and substantially horizontal playing surface S which may be constructed of materials such as concrete, cement, asphalt, or similar material. A defining characteristic of the surface S upon which the disclosed puck 1 is designed to be used is that said surface S be more rough than typical ice hockey playing surfaces (i.e. smooth ice). More specifically, the surface S upon which the disclosed puck is designed to be used is such that the coefficient of friction between the playing surface S and the exterior faces 2*a* of the outside discs 2 of the puck, (said discs 2 preferably being constructed of high density polyethylene), is greater than 0.20.

In the preferred embodiment of the invention the center fastener 5 is tightened enough so that the individual outside discs 2 and interior discs 3 do not rotate relative to each other, but are loose enough to obtain the desirable effect of allowing the discs 2 and 3 to resonate substantially independently of each other. For this reason gluing or welding of the layers, particularly at or near their respective circumferences, is not preferred.

Because the four disc members (interior discs 3 and outside discs 2) are axially aligned with each other and thus effect a substantially continuous cylindrical side wall 1*a*, when the assembled puck 1 is struck horizontally from the side by a substantially flat vertical object, (for example by an upright hockey stick), the energy of the impact is distributed approximately evenly among the four disc members (2 and 3), thereby causing the puck to move as a single body in the direction of the impact (i.e. horizontally).

However, when the assembled hockey puck 1 is impacted by a non-horizontal force, (for example when struck at an angle by a hockey stick, or when bounced against a horizontal pavement, etc.), the bulk of the impact is first incurred by an outside disc 2. The impacted outside disc 2, being a separate and discrete disc element, resonates at its own natural frequency. Some of the energy of the non-horizontal force which impacts the puck dissipates as heat of internal friction in the resonating outside disc 2, and some of the energy passes along to the adjacent disc element (i.e. to an interior disc 3). The energy which passes from the outside disc 2 to the interior disc 3 is necessarily less than the total energy of the non-horizontal impact because some of the energy is lost to the internal friction (heating) of the resonating outside disc 2.

Some of the energy that subsequently passes to the interior disc 3 from the outside disc 2 dissipates as heat of internal friction in the interior disc 3 which, being a separate discrete disc element, also independently resonates at its own natural frequency. This process of degradation of the energy of the non-horizontal force which impacts the puck continues sequentially from each disc element (2 and 3) to the next throughout the puck 1.

It will be appreciated by those skilled in the art that, because much of the energy of the non-horizontal force of impact is dissipated by the independently-vibrating disc elements, the puck constructed in accordance with the present invention will have less of a tendency to bounce (i.e. as a single unit) when dropped or struck against a rough horizontal pavement, or when hit at an angle by a hockey stick, than would a similarly sized monolithic puck constructed of similar material. Accordingly, a puck constructed in accordance with the present invention is more apt to slide flat across a playing surface, and is less apt to flip over (and start rolling) when impacted by irregularities in the topography of the playing surface, than would a similarly sized puck or monolithic molded construction. Thus, it will be appreciated that the present invention is particularly well suited for use on relatively rough playing surfaces, such as those typically encountered in the game of street hockey.

In operation, a street hockey stick is used to strike the cylindrically shaped side wall 1*a* of the puck 1, thereby transferring some of the energy of the moving stick to the puck and propelling the puck across the playing surface S. Typically, two forces act to slow the puck down, namely: sliding friction between the puck and the playing surface S, and air friction.

It is desirable for a street hockey puck to perform (on a paved playing surface) substantially similar to the way ice hockey pucks perform on smooth ice playing surfaces. Because virtually all paved street hockey playing surfaces are inherently more rough than ice, it is desirable to construct the present street hockey puck 1 (or more specifically, the outside discs 2 of the present street hockey puck) of a material whose surface 2*a* has a lower coefficient of friction against the playing surface S than would a standard (vulcanized rubber) hockey puck. For this reason the outside discs 2 of the present invention are preferably constructed of high density polyethylene (0.94 to 0.96 grams per cubic centimeter) which has a relatively lower coefficient of friction against cement, asphalt and concrete than does vulcanized rubber.

As will be appreciated by those skilled in the art, while the coefficient of friction between the playing surface S and the face of the polyethylene outside disc 2 of the present invention is advantageously lower than would be realized by, for example, vulcanized rubber against the same playing surface, the use of high density polyethylene (0.94 to 0.96 grams/cubic centimeter) rather than more dense materials, such as vulcanized rubber (1.34 to 1.46 grams/cubic centimeter), renders a puck made with the less dense material more susceptible to wind drag than are regulation ice hockey pucks. As described above, in the preferred embodiment of the present invention five 1-inch (2.54 cm) diameter holes extend between the two opposite faces 2*a* of the assembled puck.

The five 1-inch (2.54 cm) diameter holes through the 3.75" (9.52 cm) diameter puck, effectively reduce the weight of the polyethylene in the assembled puck 1 to approximately 65% (98 grams) of the weight of a solid polyethylene disc having the same outside dimension as the assembled puck. However, the net density of the materials of construction, per se, (i.e. the high density polyethylene discs and metallic pin) of the puck are not reduced. Thus, the net density of the present assembled puck 1, although comprising less mass (98 grams versus 150 grams) than a solid, monolithic, high density polyethylene disc of the same outside dimensions, is substantially the same as a solid, monolithic, high density polyethylene disc of the same outside dimensions.

Figure 5:
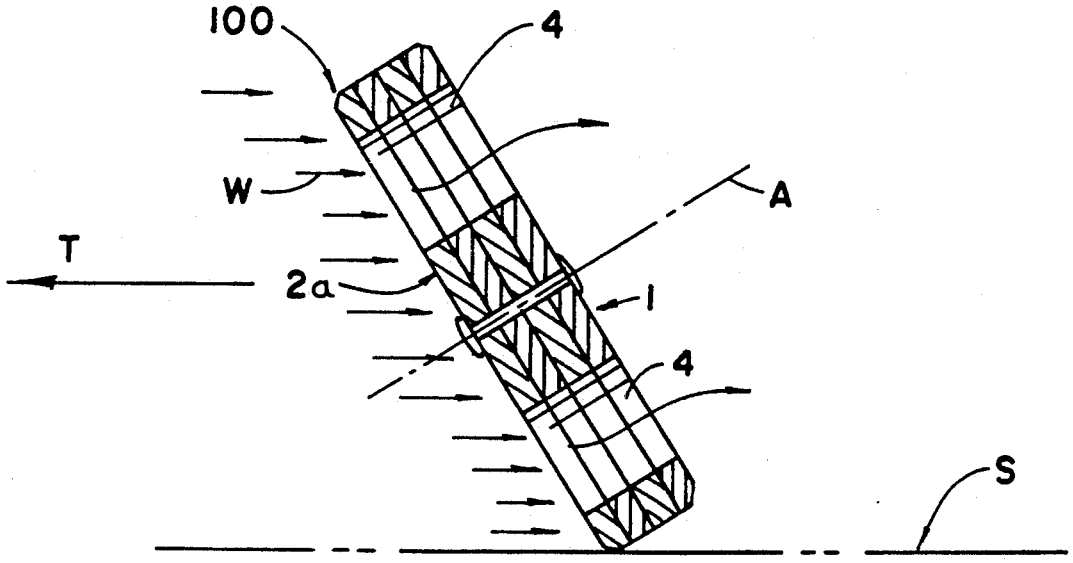
FIG. 5 is a medial cross-sectional view of the present invention showing the puck inclined relative to a horizontal playing surface.

Referring to FIG. 5: As discussed above (see Background of the Invention), at a given speed the amount of wind drag against a disc-shaped hockey puck depends only on the geometry of the puck, and is independent of the weight or the density of the puck. In the present invention, the surface area of the face 2a of the puck has an opening area totalling approximately 35% of the gross area of the face 2a of the puck. As will be appreciated by those skilled in the art, when the present hockey puck 1 is oriented as shown in FIG. 5, such that the axis A of the puck is inclined relative the playing surface S, (i.e. the puck is not lying flat on the playing surface) and the raised edge 100 of the puck is aimed in the direction of travel T of the puck, the open area in the face of the puck (resulting from the five holes 4) effectively reduces the whetted profile of the puck, and thereby reduces the total wind force W against the face 2a of the puck. Because the wind force W against the face of the puck is reduced (relative to a similarly sized solid face puck), the lifting force (i.e. the force which tends to flip the puck over) is correspondingly reduced.

As indicated above, in the preferred embodiment of the invention the net open area of the face 2a of the puck provided by the holes 4 is approximately 35% of the gross area of the face 2a of the puck. While it is possible to construct a modification of the present invention without any through holes, it has been determined that an open area of at least 10% is desirable in order to noticeably reduce the wind drag on the puck.

It will be appreciated by those skilled in the art that a hockey puck made in accordance with the foregoing specification provides a light weight street hockey puck that is particularly well adapted to be used on relatively rough paved playing surfaces; that, although relatively light weight, does not tend to flip over when slightly inclined into the wind; that, although relatively light weight, has sufficient net density to sufficiently maintain its speed through the air; and that does not tend to bounce or flip over when struck with a hockey stick by a non-horizontal blow.

In addition to the advantages described above with respect to the present invention, the holes 4 in the puck also facilitate adjustment of the overall weight of the puck during manufacture; helps to balance the puck, and reduces the amount (and corresponding cost) of materials of construction. In addition, it will be appreciated that by varying the size of the high density metallic fastener 5 in the center of the puck, the weight and density of the puck can be adjusted as desired, thus making the weight and "feel" of the puck adjustable.

While the above description contains many specificities, these should not be construed as limitations on the scope of the invention, but rather as an exemplification of one preferred embodiment thereof. Many variations are possible, for example:

Although two interior discs 2 are illustrated in the figures, any number of interior discs may be employed in the construction of the puck;

Various colors of the present invention may be used and available to optimize the contrast between the puck and the playing surface;

A modification of the invention in which there are no through-holes 4 may be constructed;

The interior discs 3 may be constructed of materials different from the outside discs 4;

The outside discs 3 may be coated with an abrasion-resistant laminate;

The number, diameter, shape and spacing of the through holes may be varied;

The outside discs 2 may be provided without beveled edges 6;

The discs 2 and 3 may be constructed of various materials other than high density polyethylene;

The outside discs 2 may be provided with convex outside faces 2a; and

Figure 6:
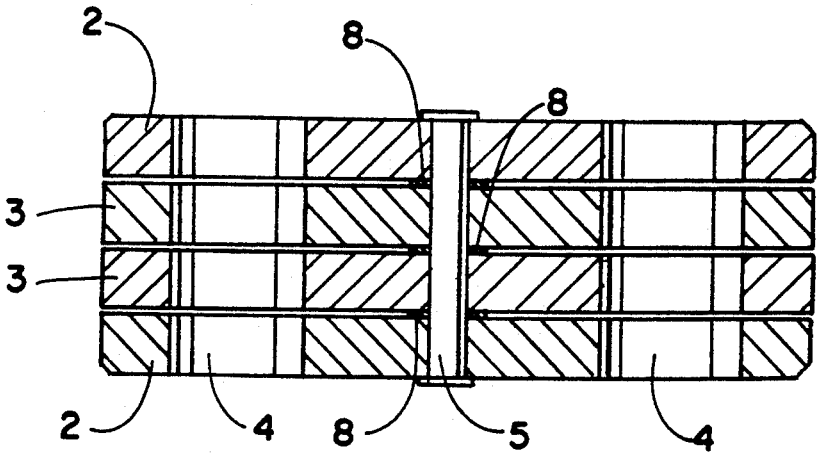
FIG. 6 is a medial cross-section view of the present invention showing a modification of the puck comprising spacer washers.

The fastener 5 may be a screw, rivet or other common fastener;

The fastener 5 may be either removable or permanently secured to the puck; and Narrow thickness (i.e. less than 0.010 inch) and small O.D. (i.e. less than 1.0 inch) washers 8 (as shown in FIG. 6), bosses, or similar spacers may be provided between adjacent disc members 2 and 3 so as to facilitate independent vibration of the individual disc members.

Accordingly, the scope of the invention should be determined not by the embodiment illustrated, but by the appended claims and their legal equivalents.

I claim:

1. A puck adapted to be slid across a substantially flat horizontal playing surface, comprising:

a first disc member, said first disc member having a first face and a second face wherein said first face of said first disc member is on the exterior of said puck;

a second disc member, said second disc member being substantially the same diameter as said first disc member, and having a first face and a second face wherein said first face of said second disc member is on the exterior of said puck;

and a third disc member disposed between said first disc member and said second disc member, and being substantially the same diameter as said first disc member;

wherein the respective centers of said first disc member, said second disc member and said third disc member are each aligned along a common axis;

and further comprising a fastener member, said fastener member being disposed along said common axis and securing said first disc member, said second disc member and said third disc member against relative movement between said first disc member, said second disc member and said third disc member perpendicular to said common axis;

and further comprising a fourth disc member, said fourth disc member having substantially the same diameter as said third disc member and being disposed between said first disc member and said third disc member;

and further comprising a plurality of openings extending through said puck from the first face of said first disc member to the first face of said second disc member;

and wherein the gross area of said plurality of openings as measured in the plane of said first face of said first disc member is at least 10% of the gross area of said first face of said first disc member;

and wherein said fastener comprises a head, wherein said head protrudes a finite distance outboard of said first face of said first disc member;

and wherein said fastener member further secures said first disc member from axial movement relative to said third disc member, and secures said third disc member from axial movement relative to said second disc member;

and further comprising a first spacer member coaxial with said first disc member, disposed between said second face of said first disc member and said third disc member.

2. The invention according to claim 1 wherein said first spacer member has a thickness, as measured parallel to said common axis, of less than 0.010 inches.

3. The invention according to claim 2, wherein said first disc member, said second disc member, said third disc member and said fourth disc member each comprise polyethylene having a density of at least 0.94 grams per cubic centimeter.

4. The invention according to claim 3, wherein:

said first disc member has a diameter of between 3 and 4 inches and a thickness, as measured perpendicular to said first face of said first disc member, of no more than ⅜ inch;

and wherein said plurality of openings comprises at least five holes, each of said holes having a circular cross-sectional area, and each of said holes having a diameter of at least 0.50 inches.

5. The invention according to claim 4 wherein the dynamic coefficient of friction between said first face of said first disc member and said playing surface is at least 0.20.

6. A puck adapted to be slid across a pave playing surface, comprising:

a first disc member, said first disc member having a first face and a second face and a continuous side therebetween, wherein said first face of said first disc member is on the exterior of said puck;

a second disc member, said second disc member being substantially the same diameter as said first disc member, and having a first face and a second face wherein said first face of said second disc member is on the exterior of said puck;

and a third disc member disposed between said first disc member and said second disc member, and being substantially the same diameter as said first disc member;

wherein the respective centers of said first disc member, said second disc member and said third disc member are each aligned along a common axis;

and further comprising means for securing said first disc member, said second disc member and said third disc member against relative rotational displacement therebetween, said means comprising a fastener member disposed along said common axis;

and further comprising a plurality of openings extending continuously through said puck from the first face of said first disc member to the first face of said second disc member.

7. The invention according to claim 6, wherein the total cross-sectional area of said plurality of openings as measured parallel to the plane of said first face of said first disc member is at least 10% of the gross area of said first face of said first disc member, from said first face of said first disc member to said first face of said second disc member.

8. The invention according to claim 7 wherein the dynamic coefficient of friction between said first face of said first disc member and said playing surface is at least 0.20.

9. The invention according to claim 7 wherein said first face of said first disc member has a dynamic coefficient of friction of no greater than 0.40 on clean, dry asphalt pavement.

10. The invention according to claim 9 wherein said first face of said first disc member has a dynamic coefficient of friction of no greater than 0.40 on clean, dry concrete pavement.

11. The invention according to claim 7 wherein said plurality of openings comprises at least five holes, each of said holes having a circular cross-sectional area, and each of said holes having a diameter of at least 0.50 inches.

12. The invention according to claim 7 wherein the diameter of said first disc member is at least four times as great as the distance between said first surface of said first disc member and said first surface of said second disc member.

13. The invention according to claim 6, wherein said fastener comprises a shaft member and a head member, said head member having a cross-sectional area perpendicular to said axis which is greater than the cross-sectional area of said shaft member perpendicular to said axis;

and wherein said head member is recessed within said first disc member, such that said head member does not protrude outboard of said first face of said first disc member.

14. The invention according to claim 6 wherein:

said first disc member has a net density of less than 1.3 grams per cubic centimeter; and said shaft member has a density at least five times the density of said first disc member.

15. The invention according to claim 14 wherein said first disc member and said second disc member each comprise polyethylene having a density of at least 0.9 grams per cubic centimeter.

16. A device comprising:

a cylindrically shaped impact resistant puck body adapted to slide across a substantially flat surface when said puck body is struck by a stick, said puck body having a first exterior face and a second exterior face;

wherein the diameter of said puck body is at least four times as great as the distance between said first face and said second face;

a plurality of openings continuously extending unobstructedly through said puck body from said first face to said second face, wherein said plurality of openings comprises at least five holes, each of said holes having a circular cross-section, and each of said holes having a diameter of at least 0.50 inches;

wherein said puck body comprises a first disc member, said first disc member comprising a plastic material having a density of at least 0.9 grams per cubic centimeter and less than 1.3 grams per cubic centimeter;

and said first face having a dynamic coefficient of friction on clean, dry asphalt of between 0.20 and 0.40.

17. The device according to claim 16 wherein:

said puck body further comprises a second disc member and a third disc member;

wherein said first disc member, said second disc member and said third disc member are each cylindrically shaped, have substantially equal diameters, and are concentric about an axially disposed fastener member;

and wherein said fastener member secures said first, second and third disc members from relative rotational movement therebetween.

* * * * *